United States Patent [19]

Hasegawa et al.

[11] Patent Number: 5,025,286

[45] Date of Patent: Jun. 18, 1991

[54] LASER BEAM IMAGE FORMING APPARATUS WITH SOS DETECTION

[75] Inventors: Hirofumi Hasegawa; Naoto Ohmori; Yukio Yamada; Narutaka Yoshida, all of Osaka, Japan

[73] Assignee: Minolta Camera Kabushiki Kaisha, Osaka, Japan

[21] Appl. No.: 373,989

[22] Filed: Jun. 29, 1989

[30] Foreign Application Priority Data

Jun. 29, 1988 [JP] Japan ..... 63-162210
Jun. 29, 1988 [JP] Japan ..... 63-162211

[51] Int. Cl.[5] ..... G03G 15/04

[52] U.S. Cl. ..... 355/244; 355/66; 355/229; 355/233; 346/160

[58] Field of Search ..... 355/202, 218, 69, 228, 355/244, 220, 229, 233, 234, 75, 66; 346/160

[56] References Cited

U.S. PATENT DOCUMENTS

| | | | |
|---|---|---|---|
| 3,966,319 | 6/1976 | Lang . | |
| 4,012,585 | 3/1977 | Chen . | |
| 4,257,701 | 3/1981 | Hirayama et al. | 355/202 |
| 4,379,631 | 4/1983 | Kitamura | 355/202 |
| 4,397,537 | 8/1983 | Tamura | 355/202 |
| 4,417,805 | 11/1983 | Kishi | 355/244 X |
| 4,448,513 | 5/1984 | Hirayama et al. | 355/244 X |
| 4,552,449 | 11/1985 | Wakamatsu et al. | 355/202 |
| 4,612,555 | 9/1986 | Hongou et al. | 346/160 |
| 4,667,209 | 5/1987 | Hakamada et al. | 346/160 |
| 4,696,562 | 9/1987 | Urata et al. | 355/244 X |
| 4,749,872 | 6/1988 | Asada et al. | 355/75 X |

FOREIGN PATENT DOCUMENTS

| | | |
|---|---|---|
| 54-25736 | 2/1979 | Japan . |
| 54-130137 | 10/1979 | Japan . |
| 56-23953 | 3/1981 | Japan . |
| 61-19033 | 5/1986 | Japan . |

*Primary Examiner*—R. L. Moses
*Assistant Examiner*—Nestor R. Ramirez
*Attorney, Agent, or Firm*—Price, Gess & Ubell

[57] ABSTRACT

An image forming apparatus comprising a laser beam radiating unit utilized as a light source, and an optical system that the surface of an original reflects a laser beam radiated from the radiating unit to project an image reflected form the original onto a photosensitive member. In this apparatus, an image is formed selectively in a print mode that an image results from turning on and off the laser beam, in a copy made that a copy of an original results form exposure of the photosensitive member to the laser beam reflected from the surface of an original or in a composite mode that a composite image is formed of a copy of an original and an image resulting from turning on and off the laser beam. Also, this apparatus comprises a reflecting member which is provided on an original supporting table and extends in the sub scanning direction, and a sensor for detecting the laser beam reflected from the reflecting member. A signal produced by the sensor is used as a signal for setting a starting point in outputting image data, a start signal for starting outputting image data in the sub scanning direction and a completion signal for finishing the scanning.

10 Claims, 6 Drawing Sheets

LASER BEAM IMAGE FORMING APPARATUS WITH SOS DETECTION

BACKGROUND OF THE INVENTION

1. Field of the Invention

The present invention relates to an image forming apparatus, and more specifically, an image forming apparatus wherein a photosensitive member charged with a specified potential beforehand is exposed to a laser beam responding to image data so that an electrostatic latent image is formed on the photosensitive member, and then the latent image becomes visible on a sheet of paper.

2. Description of Related Art

Generally, regarding an image forming apparatus wherein an electrostatic latent image on a photosensitive member is caused by exposure to light with image data, and then the latent image appears on a paper sheet, an electrophotographic copier wherein a copy of an original results from reflection and a laser printer wherein a laser beam is turned on and off in accordance with image data are known. These apparatuses are different from each other only in measure of exposure, and the other elements of an image forming section except a light source can be commonly used in the apparatuses.

Therefore, Japanese Laid Open Patent Publication No. 54-25736 suggests an image forming apparatus for which exposure means utilizing the reflection of an original and exposure means utilizing a modulated laser beam are both provided, wherein the other image forming elements are commonly used. This arrangement enables an image to be formed selectively by the reflected light from an original or the modulated laser beam.

In this apparatus, however, it is impossible to form a composite image by using both the reflected light from an original and the laser beam simultaneously. For, in this apparatus, the light to be reflected by the surface of an original and the laser beam are emitted from different light sources, and their optical paths are different except the last portion of them.

Further, in an image forming apparatus with a function of printing with a modulated laser beam, when a scanning device which is equipped with a plurality of equally divided deflecting surfaces such as a polygon mirror is used for scanning the laser beam in the main scanning direction in order to compensate an error in formation of each deflecting surface, a sensor for detecting a starting point of printing in each scan is so arranged that the focus of the laser beam on the sensor is equivalent to that on the photosensitive member. However, when forming a composite image, it is impossible to use the sensor as it is.

SUMMARY OF THE INVENTION

It is, therefore, an object of the present invention to provide an image forming apparatus wherein not only the reproduction of an original and the image forming with use of a modulated laser beam can be separately and simultaneously performed but also the various signals needed for the image forming can be input and output in a simple structure.

To attain the above-mentioned object, an image forming apparatus according to the present invention is an apparatus wherein an electrostatic latent image is formed on a photosensitive member charged with specified potential, the photosensitive member being exposed to light from a light source, and the latent image is developed and then transferred onto a sheet of paper. The image forming apparatus comprises a laser beam radiating unit including a radiant element and a scanning device; optical means for guiding the laser beam radiated from the laser beam radiating means to an original supporting means and for projecting an image reflected from an original onto the photosensitive member; reflecting means which is provided on the original supporting means outside of the area where an original is placed and extends in the sub scanning direction of the laser beams; a sensor for producing a signal which determines the timing of starting outputting image data in the main scanning direction of the laser beam on detecting the laser beam reflected from the reflecting means and control means for turning on and off the radiant element in response to the signal produced by the sensor so that the laser beam is modulated in accordance with image data.

With this arrangement, when the laser beam radiating means is kept on so that the surface of the original keeps on reflecting the laser beam, the image of the original is projected onto the photosensitive member, thereby reproducing the image of the original. Also, when the laser radiating means is turned on and off to radiate the laser beam in accordance with image data with the reflecting surface white, an image is formed only in response to turning on and off the laser beam. Further, when an original is set on the original supporting means, and at the same time the laser beam radiating means is turned on and off in accordance with image data, a composite image is formed of a copy of the original and an image resulting from turning on and off the laser beam. The laser beam reflected from the reflecting means provided on the original supporting means is detected by the sensor, and the sensor produces a signal. The signal determines a starting point, where the laser beam is started to be modulated in accordance with image data, in the main scanning direction. In a composite mode, the timing of starting outputting image data in the sub scanning direction can be determined, too. Thus, the timing of starting the modulating the laser beam in accordance with image data is synchronized with the timing of starting a copying cycle, an original, and accordingly this arrangement is very effective in making a composite image.

Further, the reflecting means provided on the original supporting means has a distinct part which reflects the laser beam differently from the other parts at the trailing edge relatively to the sub scanning direction, and when the sensor detects the laser beam reflected from the distinct part, the exposure of an original and the scan of the laser beams are completed.

BRIEF DESCRIPTION OF THE DRAWINGS

This and other objects and features of the present invention will become apparent from the following description taken in conjunction with the preferred embodiment thereof with reference to the accompanying drawings.

DESCRIPTION OF THE PREFERRED EMBODIMENT

A preferred embodiment of an image formIng apparatus according to the present invention are described below in reference to the accompanying drawings. Further, the same numerals are given to the same parts and members in all the drawings.

Figure 1:
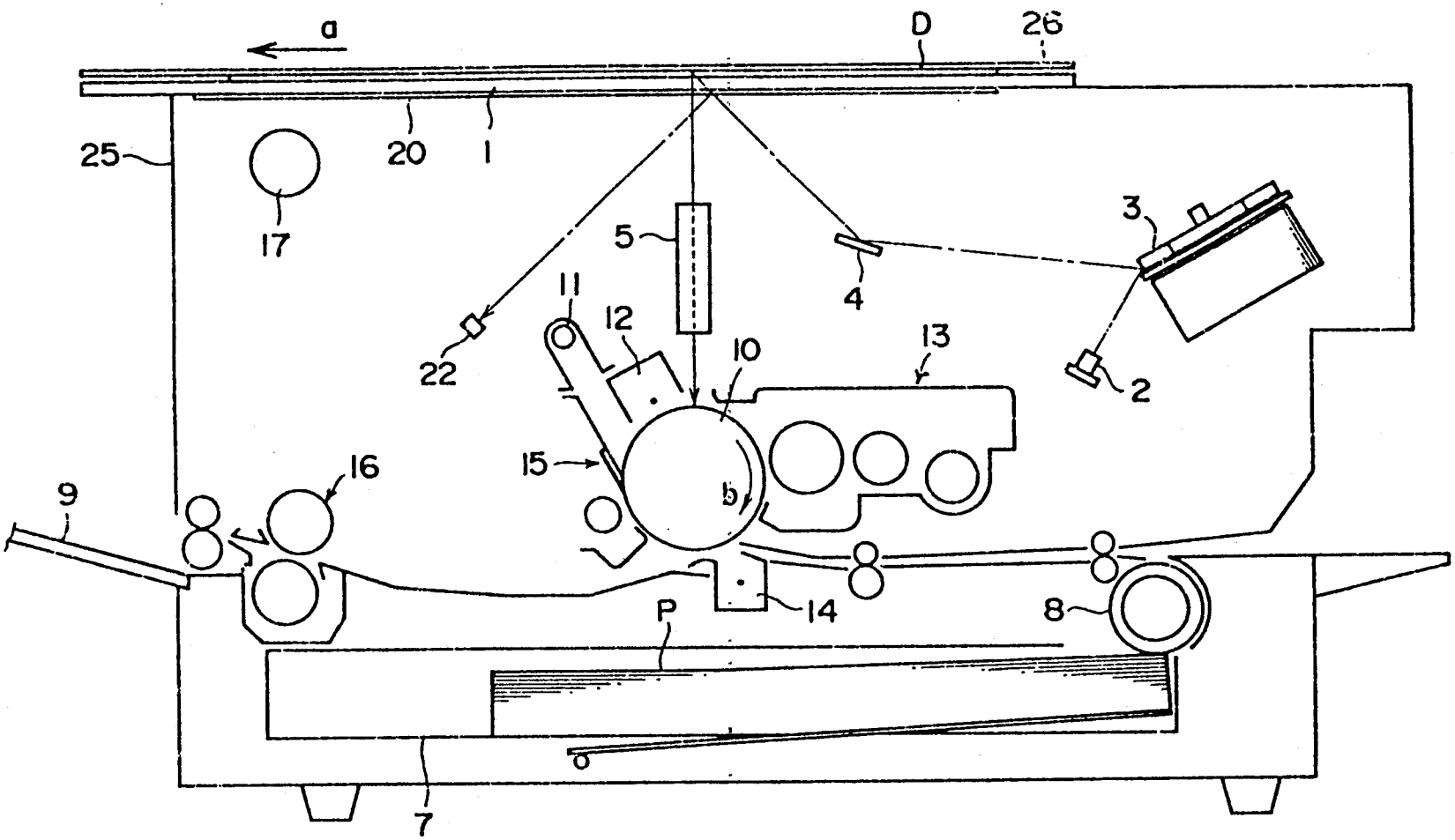
FIG. 1 is a schematic view of the image forming apparatus showing its general constitution.

Numeral 1 in FIG. 1 is an original glass which can slide by the rotation of a motor 17 in the direction of the arrow a on a body 25 of an apparatus, and FIG. 1 shows a state wherein the original glass 1 is sliding. Numeral 2 is a laser diode. Numeral 3 is a polygon mirror enabling a laser beam to scan; Numeral 4 is a mirror. Numeral 5 is a lens array equipped with an optical fiber. A laser beam emitted from the laser diode 2 irradiates each surface of the polygon mirror 3, and the reflected light irradiates the mirror 4, thereby being directed to an original D or the reverse side of an original cover 26 to scan the surface. Then, the surface of a photosensitive drum 10 is exposed to the reflected light through the lens array 5. The laser diode 2 is controlled to be turned on and off by a drive circuit in accordance with an image signal produced from an image control device. The polygon mirror 3 is driven to rotate at a specified frequency. Such a control system of the image signal is so well-known that the detailed description is omitted.

The photosensitive drum !0 can be driven to rotate in the direction of the arrow b, and around the drum 10, an eraser lamp 11 for erasing residual charge, an electric charger 12, a developing device 13 taking a magnetic brush way, a transferring charger 14, a cleaning device 15 for removing residual toner with a blade, etc are arranged. Copying paper P is fed sheet by sheet from a feeding cassette 7 which is removable and disposed at the lower part of the body 25 of the apparatus. A sheet fed from the cassette 7 makes a U-turn around a feeding roller 8, and when the sheet passes between the transfer charger 14 and the photosensitive drum 10, a toner image is transferred thereon. Thereafter, the sheet is transported to the left, and the toner image is fixed thereon by heat at the fixing device 16. Then, the sheet is discharged onto a tray 9.

Figure 2:
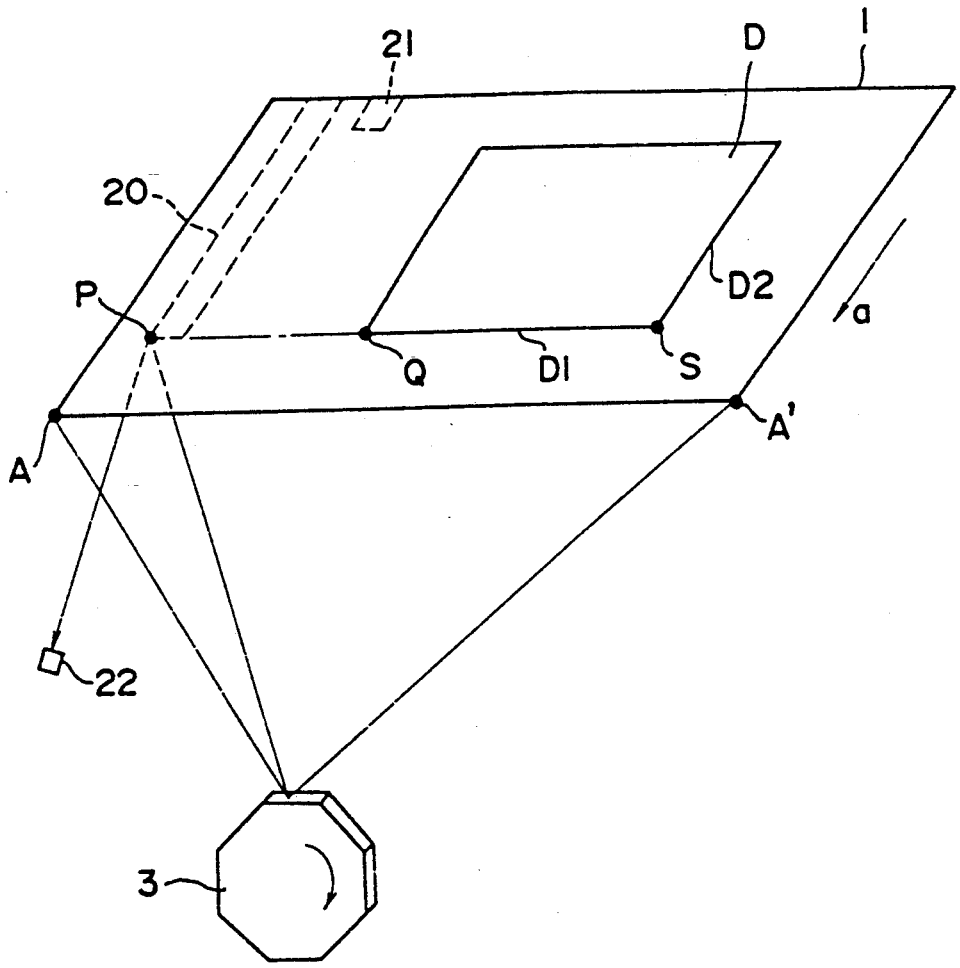
FIG. 2 is a perspective view showing the scanning of a laser beam and the positional relation between a reflecting member and an original.

On the other hand, as shown in FIGS. 1 and 2, rectangular reflecting members 20 and 21 are provided on the reverse side of the original glass 1, and a sensor 22 (which is hereinafter referred to as an SOS sensor) for detecting light reflected from the reflecting members 20 and 21 and determining a point where output of image data is started is also provided.

The reflecting members 20 and 21 are arranged out of an area on the original glass 1 where an original is placed, that is, outside of the area where an original of the maximum size is placed, and the reflecting members 20 and 21 extend in the sub scanning direction (refer to the arrow a). The reflecting member 20 extends from a leading edge standard D1 to the trailing edge of the original glass 1, and the other reflecting member 21 is so arranged that the original glass 1 stops moving in the direction a and starts returning when the reflecting member 21 reflects the laser beam. Also, an original D is placed on the original glass 1 with its leading edge positioned along the line D1 and its side positioned along the line D2.

The SOS sensor 22 is installed in order to compensate for an error of the recorded position in the direction of each scan of the laser beams which is caused by an error in dividing the polygon mirror 3 into deflecting surfaces, and the SOS sensor 22 is exactly so disposed that the focus of the laser beam on the sensor 22 is equivalent to that on the photosensitive drum 10 and fixed on a frame not shown in the drawings of the main body 25.

The process of forming an image on a sheet of copying paper in the above-described constitution is hereinafter described.

Figure 5A:
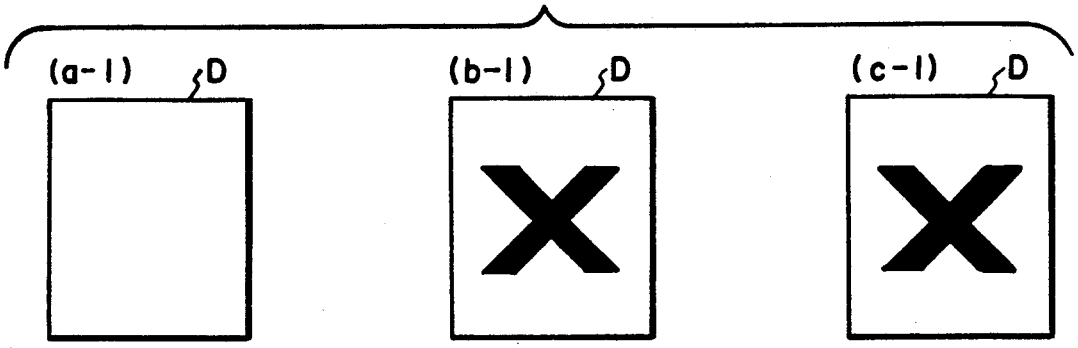
FIG. 5 is a drawing explaining the relations among the surface of an original, and output from a laser diode and a latent image.
Figure 5B:
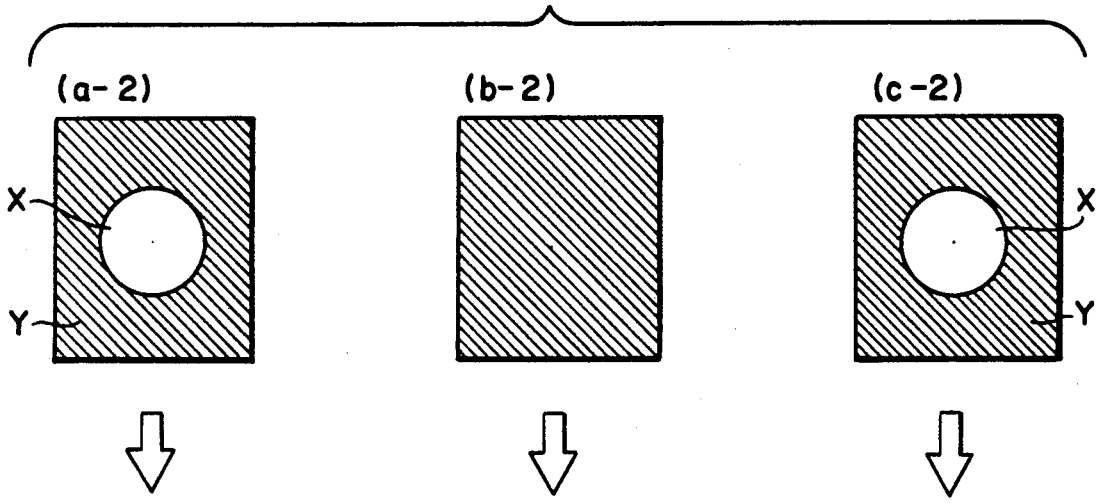
Figure 5C:
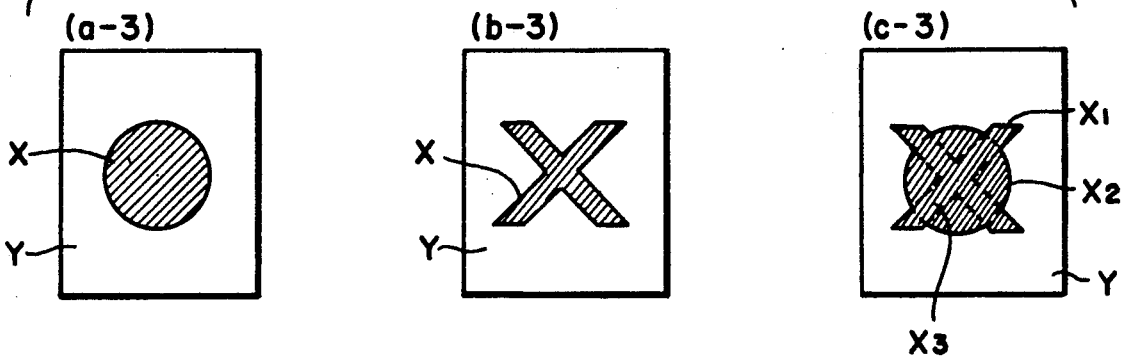

First, in a case of printing an image with the modulated laser beam, as shown by FIG. 5, (a-1), a white blank sheet D should be placed on the original glass 1 as a reflecting surface, or the reverse side of the original cover 26 should be used as a reflecting surface, and then image data is output from the laser diode 2. For example, referring to FIG. 5, (a-2), the laser diode 2 is kept off while an imaged portion X in the shape of a circle is scanned, and the laser diode 2 is kept on while a background Y shown by oblique lines in the drawing is scanned. Thereby, as shown by FIG. 5, (a-3), an electrostatic latent image is formed on the photosensitive drum 10 of the imaged portion X maintaining electric charge and the background Y where electric charge was erased.

Also, in order to print out a copy of an original, the original should be placed on the original glass 1, the laser diode 2 should be kept on all the time, and the original glass 1 should be moved at a specified speed. For example, when the laser diode 2 keeps on emitting the laser beam [FIG. 5, (b-2)] to an original D as shown by FIG. 5, (b-1), an electrostatic latent image is formed on the photosensitive drum 10 of an imaged portion X maintaining electric charge and a background Y where electric charge was erased, as shown by FIG. 5, (b-3).

Further, in a case of printing out a composite image of a copy of an original and an image resulting from turning on and off the laser beam, an original D should be placed on the original glass 1 to be moved at a specified speed, and at the same time the laser diode 2 should be turned on and off to output image data. For example, the laser diode 2 radiates the laser beam to an original D as shown by FIG. 5, (c-1), being off while an imaged portion X in the shape of a circle shown by FIG. 5, (c-2) is scanned and being on while a background Y as shown by oblique lines in the drawing is scanned. Thereby, a composite electrostatic latent image is formed of two images as shown by FIG. 5, (c-3). In this case, the portion shown by Xl, which was exposed to the laser beam, remains charged because it corresponds to an imaged portion of the original D. The portion shown by X2, which corresponds to a background of the original D, remains charged because it was not exposed to the laser beam. The portion shown by X3 remains charged because it corresponds to an imaged portion of the original D and was not exposed to the laser beam. In the other portion Y, the charge is erased, and the portion Y becomes a background.

Figure 6A:
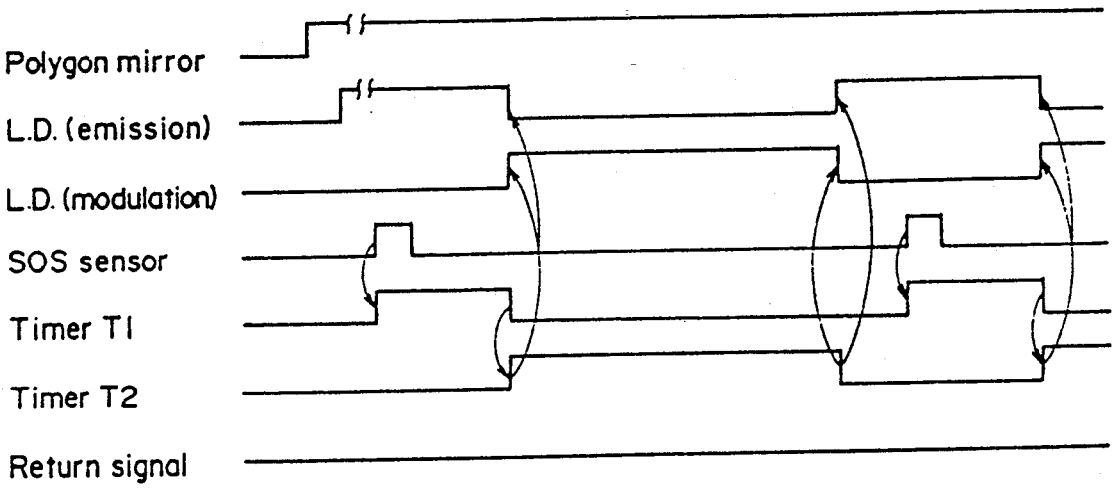
FIGS. 6*a* and 6*b* are time charts showing procedure for an optical system.

In the image forming operation as described above, the laser beams are spread on the original glass 1, between A and A' in FIG. 2 by the polygon mirror 3, and the original glass 1 is moved in the direction of the arrow a. Incidentally, the scanning by the polygon mirror 3 is defined as the main scanning, and the scanning by the movement of a original is defined as the sub scanning. When the laser beam is reflected on a point P at a corner of the leading edge of the reflecting member 20, and the SOS sensor 22 detects the reflected light, the SOS sensor 22 outputs an SOS signal to a mechanical control unit 51 (refer to FIG. 4). As shown in FIG. 6*a*, when the SOS sensor 22 produces the SOS signal, a timer T1 is started. The time which is required for the laser beam to reach a side Q of an original D from the point P is incorporated into the timer T1. When the timer T1 counts up the time, a timer T2 is started, and the laser diode 2 is changed to modulate the laser beam in accordance with image data (to output image data). The time which is required for the laser beam to reach the other side S of the original D from the side Q is incorporated into the timer T2. When the timer T2 counts up the time, the laser diode 2 is changed again to radiate the laser beam all the time. Thereafter, the above described operation is repeated for each scan.

Figure 6B:
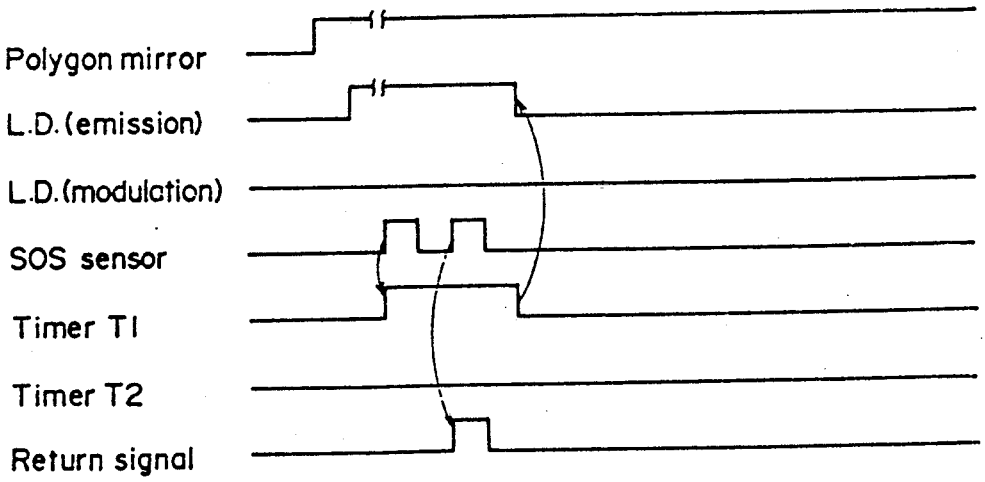

When the original glass 1 gets to the state that its movement should be stopped, as shown in FIG. 6*b*, the SOS sensor 22 detects light reflected from the reflecting member 20 and subsequently light reflected from the reflecting member 21. At that time, the SOS sensor 22 produces a return signal, thereby commanding to stop the radiation from the laser diode 2 and to start the return of the original glass 1.

Also, the combination of the reflecting members 20 and 21 with the SOS sensor 22 functions as an SOS signal producing means and means for producing a start signal and a completion signal (return signal) of the original image exposure the SOS sensor 22, as described above, is not incorporated into a box of an optical unit but fixed on a frame of the body 25, so that accuracy of the position is relatively improved and the position can be adjusted easily. Further, the improvement of accuracy of the position solves the lag in forming a composite image.

Further, the diameter of the laser beam which irradiates the surface of an original needs to be narrowed enough in order to reproduce the image of an original well. Unless the diameter of the laser beam is narrowed, the laser beam will be apt to irradiate both white and black portions of an original at a time, and the scattering coefficient of the reflection on the surface of the original will be large, resulting in poor image reproduction.

Figure 3:
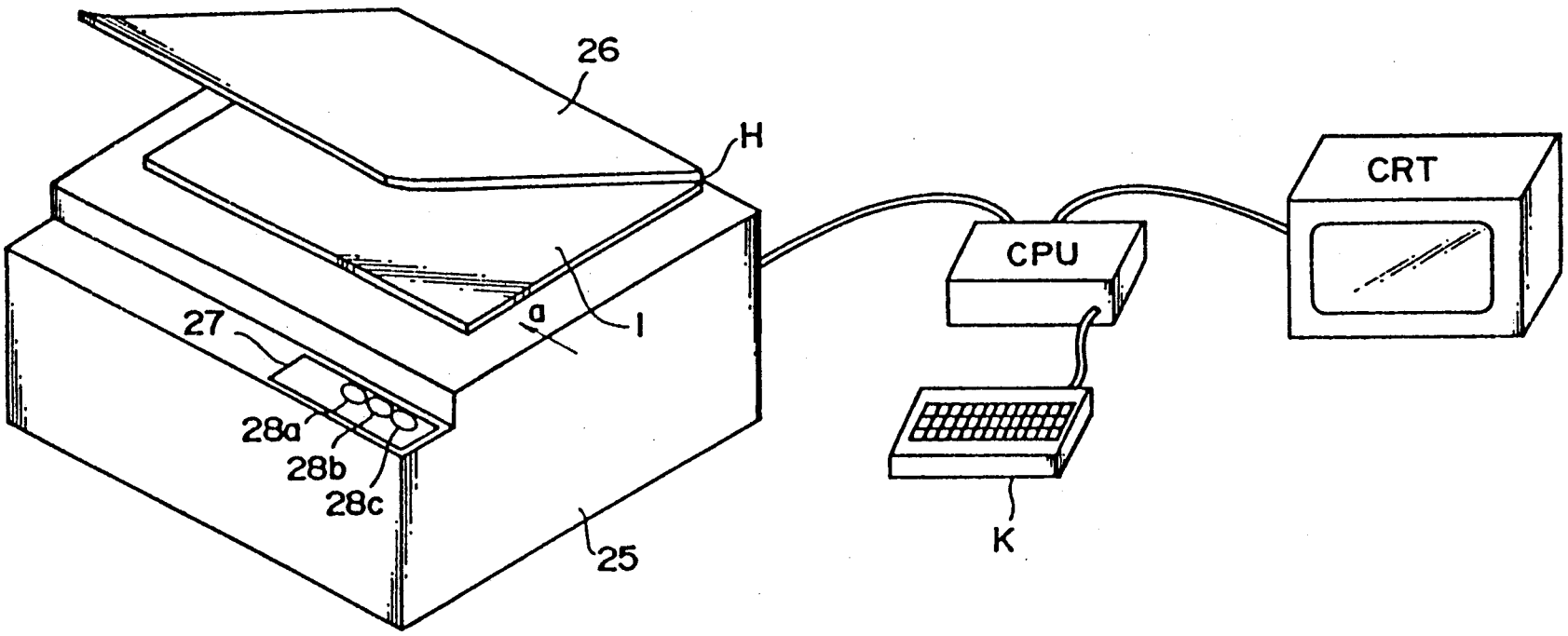
FIG. 3 is a perspective view of a whole apparatus.

The apparatus as a whole is constituted as shown in FIG. 3. The main body 25 of the image forming apparatus is connected to a host computer CPU which is operated with a keyboard K, and the host computer CPU is connected to a display device CRT.

Figure 4:
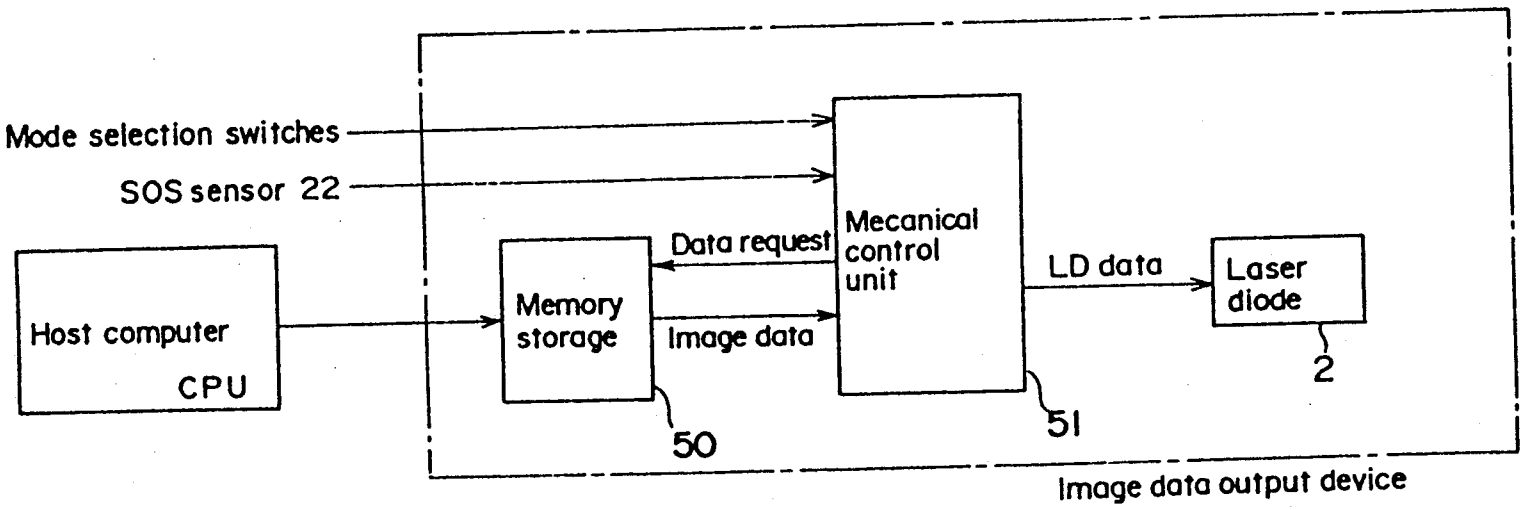
FIG. 4 is a block diagram showing a control circuitry.

The host computer CPU is connected to a memory storage 50 of an image data output device (refer to FIG. 4). The memory storage 50 outputs Image data in response to a data requiring signal from a mechanical control unit 51, and the laser diode 2 is controlled in accordance with the image data.

A copy mode selection switch 28*a*, a print mode selection switch 28*b* and a composite mode selection switch 28*c* are provided on a control panel of the body 25, and each mode is selected when a corresponding switch is turned on. Signals produced from these switches 28*a*, 28*b*, 28*c* and the SOS sensor 22 are input into the mechanical control unit 51 so that the mechanism control unit 51 can perform necessary control.

Further, the laser beam can irradiate the surface of an original directly without being reflected on the mirror 4. Also, as a photosensitive member, not only the one on which an electrostatic latent image is formed but also a silver salt film can be used.

Furthermore, as means of scanning the image of an original, a moving original glass has been adopted in this embodiment, but the optical system can be so made to be movable instead. Also, it is possible that the reflecting member 20 is protruded from the upper surface of the original glass 1 to be a standard in positioning an original D on the original glass 1. With this arrangement, the lag in forming a composite image of a copy of an original and an image resulting from the modulated laser beam can be furthermore prevented. The reflecting members 20 and 21 can be disposed on the original cover 26.

In this embodiment, the SOS sensor 22 also functions to produce signals which control the image exposure, but it is possible to provide sensors to be separately used for each object.

Although the present invention has been described in connection with the preferred embodiment thereof, it is to be noted that various changes and modifications are apparent to those who are skilled in the art. Such changes and modifications are to be understood as included within the scope of the present invention as defined by the appended claims, unless they depart therefrom.

What is claimed is:

1. An image forming apparatus, comprising:

supporting means for supporting an original;

a rotatable photosensitive member;

a laser beam radiating unit including a radiant element and a scanning device;

optical means for guiding the laser beam radiated from said laser beam radiating unit to said supporting means and for projecting a reflected image of the original onto said photosensitive member;

scanning means for relatively scanning the reflected image in the direction perpendicular to the direction in which said scanning device spreads the laser beams on the original;

reflecting means for reflecting the laser beam radiated from said laser beam radiating unit, said reflecting means being provided on said supporting means outside of the area where said original is placed and extending in the scanning direction by said scanning means;

a sensor for producing a signal which determines the timing of starting outputting image data in the scanning direction by said scanning device on detecting the laser beam reflected from said reflecting means; and control means for turning on and off said radiant element in response to the signal produced by said sensor so that the laser beam is modulated in accordance with image data.

2. An image forming apparatus as claimed in claim 1, wherein said reflecting means has a distinct part which reflects the laser beam differently from the other parts at the trailing edge relatively to the scanning direction by said scanning means, and when said sensor detects the laser beam reflected from the distinct part, the scan of the laser beam by said scanning means is completed.

3. An image forming apparatus as claimed in claim 1, wherein said control means further determines the timing of starting outputting image data in the scanning direction by said scanning means in accordance with the first signal produced from said sensor.

4. An image forming apparatus, comprising:

an original glass for supporting an original, said original glass being provided with an openable original cover;

a rotatable photosensitive member;

a laser beam radiating unit including a radiant element for radiating a laser beam and a scanning device for scanning the laser beam in a first direction;

optical means for guiding the laser beam radiated from said laser beam radiating unit to said original glass and for projecting an image reflected from an original onto said photosensitive member;

scanning means for relatively scanning the reflected image in a second direction perpendicular to the first direction;

modulating means for modulating the laser beam radiated from said radiant element in accordance with image data;

reflecting member provided on said original glass;

detecting means for detecting the laser beam reflected from said reflecting member and producing a signal on detecting the laser beam; and control means for starting the modulation of the laser beam in response to the signal produced by said detecting means.

5. An image forming apparatus as claimed in claim 4, wherein said control means determines the timing of starting outputting image data in the second direction.

6. An image forming apparatus as claimed in claim 4, further comprising:

a second reflecting member provided at the trailing edge of the original glass in the second direction; and second control means for stopping the radiation of the laser beam when said detecting means detects the laser beam reflected from said second reflecting member.

7. An image forming apparatus as claimed in claim 4, further comprising:

a second reflecting member provided on the original glass, and second control means for terminating the scanning movement of said scanning means when said detecting means detects the laser beam as reflected from said second reflecting member.

8. An image forming apparatus as claimed in claim 7, wherein said second control means terminates the scanning movement of said scanning means when said detecting means detects the laser beam as reflected from said second reflecting member during a predetermined period after the detection of the laser beam as reflected from said first reflecting member.

9. An image forming apparatus as claimed in claim 4, wherein said reflecting member whose side portion extends in a direction parallel to the second direction and said control means determines the timing of starting outputting image data in the second direction.

10. An image forming apparatus as claimed in claim 9, further comprising:

a second reflecting member provided on the original glass at a trailing edge of the glass relative to the second scanning direction, and second control means for terminating the scanning movement of said scanning means when said detecting means detects the laser beams reflected from said first reflecting member and said second reflecting member.

* * * * *

UNITED STATES PATENT AND TRADEMARK OFFICE

CERTIFICATE OF CORRECTION

PATENT NO. : 5,025,286

DATED : June 18, 1991

INVENTOR(S) : Hirofumi Hasegawa, et al

It is certified that error appears in the above-identified patent and that said Letters Patent is hereby corrected as shown below:

Col. 6, line 38, delete both occurrences of "the" and insert --a-- therefor;

Col. 6, line 40, delete "beams" and insert --beam--.

Signed and Sealed this

Thirteenth Day of October, 1992

*Attest:*

DOUGLAS B. COMER

*Attesting Officer*

*Acting Commissioner of Patents and Trademarks*